United States Patent [19]

Wirth et al.

[11] Patent Number: 5,020,677

[45] Date of Patent: Jun. 4, 1991

[54] COMMON RACK SYSTEM FOR ANODIZING AND PAINTING LARGE PARTS

[75] Inventors: David J. Wirth; Mike M. Zaragoza, both of Seattle, Wash.; Jon Rosner, Chicago, Ill.

[73] Assignee: The Boeing Company, Seattle, Wash.

[21] Appl. No.: 505,911

[22] Filed: Apr. 6, 1990

[51] Int. Cl.[5] ..... A47F 5/00

[52] U.S. Cl. ..... 211/113; 118/500; 204/297 W

[58] Field of Search ..... 211/113, 117, 118; 118/500, 503; 204/297 R, 297 W

[56] References Cited

U.S. PATENT DOCUMENTS

| | | | |
|---|---|---|---|
| 1,010,648 | 12/1911 | Leffel . | |
| 2,253,576 | 8/1941 | Palmer | 204/297 |
| 2,514,923 | 7/1950 | Batina | 204/297 W |
| 2,541,597 | 2/1951 | Midling | 204/297 |
| 2,652,359 | 9/1953 | Schneider | 204/297 W |
| 2,697,690 | 12/1954 | Beebe, Jr. | 204/297 |
| 3,366,567 | 1/1968 | Elbaum | 204/297 W |
| 4,037,727 | 7/1977 | Kunkle | 211/117 |
| 4,679,526 | 7/1987 | Dziedzic | 118/503 |

OTHER PUBLICATIONS

Milo, M. G., "Supporting Rack for Circuit Boards During Electroplating", Technical Digest No. 20, Oct. 1970, pp. 51-52/Western Electric.

*Primary Examiner*—Robert W. Gibson, Jr.
*Attorney, Agent, or Firm*—Bruce A. Kaser

[57] ABSTRACT

A common rack system is provided for sequentially anodizing and painting parts. The parts (14) are mounted on rack bars (18) and secured in place with straddle clips (16). An anodization bar (20) that is substantially thicker than the rack bar (18) is clamped to each rack bar (18) to provide the current-carrying capacity needed for good anodization. After the parts are anodized, the anodization bars (20) are then unclamped and removed from the rack bars (18), and the parts are painted while still mounted to the rack bars. The rack bars (18) are quite thin so as to minimize paint shadowing. Only minor touch-up painting is necessary after the parts (14) are subsequently removed from the rack bars (18).

13 Claims, 3 Drawing Sheets

12
14
16
18
20
22
24
30
40
43
10

20
38
41
18
14
16d
45
40
31
16a
30
34
16b
16

COMMON RACK SYSTEM FOR ANODIZING AND PAINTING LARGE PARTS

TECHNICAL FIELD

This invention relates to racking systems which hold parts during plating, anodizing, and painting operations, and in particular, to a common rack for holding long or large parts, the rack having sections which are disconnected inbetween the sequence of anodizing and painting the parts.

BACKGROUND ART

Each year, literally millions of aluminum aircraft parts are anodized and painted in order to protect them against corrosion. Current industry practice in applying these finishes typically involves first placing a large number of parts on a rack, followed by anodizing all parts at the same time, and then unloading the rack and painting each part individually. Painting is generally accomplished via conventional spray painting techniques.

Because of the large numbers of parts involved, there are high labor costs associated with unracking. Eliminating or even reducing some of this labor can have significant cost benefits to the manufacturer. For this reason, there has been a long-felt need to develop better racks or racking systems that can permit parts to be both anodized and painted without unracking.

Most racking systems which are well-suited for anodizing or electroplating are not well-suited for painting, and vice versa. The reason for this is that each process has unique requirements that do not complement the other.

For example, anodizing and/or electroplating requires good electrical contact and continuity between the rack and parts. Generally, the rack must be capable of carrying large electrical currents This requires that the rack be made of an electrically-conductive material, and have large or heavy structure that is sufficient to carry the needed current loads Such requirements, however, are opposite to the requirements for a painting rack. There, the amount of structure should be minimized in order to reduce, as much as possible, shielding of the paint spray which causes shadowing.

In the past, it has not been economical to use common racks for both anodizing and painting in connection with large, elongated aircraft parts The structural make-up of the typical racking system was such that it shielded large areas of the parts from the paint spray. It was found that the large amount of labor associated with touching up shadowed areas increased overall production costs to such an extent that it was more expedient to unrack the parts after anodizing, and then paint them once-over by hand.

The following U.S. patents disclose racks which are suitable for anodizing or electroplating, but are unsuitable for painting: Leffel U.S. Pat. No. 1,010,648 issued on Dec. 5, 1911; Palmer U.S. Pat. No. 2,253,576 issued on Aug. 26, 1941; Midling U.S. Pat. No. 2,541,597 issued on Feb. 13, 1951; and Beebe U.S. Pat. No. 2,697,690 issued on Dec. 21, 1954. Although the racks disclosed in all of these patents generally meet the requirements for plating operations, none are suitable for painting because, as discussed above, they have too much shielding structure.

The patent literature does disclose certain kinds of racking systems that are suitable for both plating and painting operations. Notable examples of this re Kunkle U.S. Pat. No. 4,037,727 issued on July 26, 1977, and Dziedzic U.S. Pat. No. 4,679,526 issued on July 14, 1987. Similarly, co-pending U.S. patent application Ser. No. 07/269,580, filed on Nov. 10, 1988, and naming two inventors who are also named here, discloses a racking system that is effective for both anodizing and painting operations. However, all of these systems are usable in connection with plating and painting small parts, with some having greater utility than others. Unlike the present invention, none are particularly suitable for racking large parts.

SUMMARY OF THE INVENTION

The invention is a common rack system that can be used for both anodizing and painting large aircraft parts without unracking them inbetween these two distinct process steps. The system includes a plurality of common rack units, each having two electrically conductive elongated bars. One of the bars is a rack bar that holds the parts during both anodizing and painting. The second bar is an anodizing bar which is used only during the first step, that is to say, while the parts are anodized. Both bars hang vertically downwardly from an overhead support.

The anodizing bar has a substantially larger cross-section than the rack bar. It is easily clamped or otherwise joined to the rack bar in a manner so that a large area of electrical contact is created along their lengths. The anodizing bar's larger cross-section provides the electrical current-carrying capacity needed for anodizing the parts held by the rack bar. After anodizing, it is then detached and removed from the rack so that it has no effect on shadowing during painting.

The rack bar is preferably a thin, rectangular bar whose thickness is substantially less than its width. Further, it has a plurality of part-supporting fingers that project outwardly and slightly upwardly from one of its thin sides. These support the parts while they are anodized and painted, and more specifically, the parts are supported along their length by a plurality of rack bars having this configuration.

The anodizing bar is clamped to the rack bar by a pair of clamping brackets attached to the anodizing bar. These brackets are shaped in a manner so that they can slidably receive one laterial edge of the rack bar. They have conventional wing bolts which are operative to firmly press the rack bar against one side of the anodizing bar so that good electrical contact is created between them.

Parts to be anodized and painted are held on the rack bar's fingers by straddle clips. Each rack bar has a plurality of socket openings distributed along and in its wide side. The straddle clips are formed of spring wire, and have a coiled central portion, and a pair of arms extending outwardly from opposite sides of the coiled portion. These arms terminate in bent ends or tips that are perpendicular to the arms. The tips are insertable into the rack bar's socket openings for the purpose of attaching the clips to the rack bar. Each clip, when in use, has one arm normally located above a part, and the other arm normally below. Tension in the clip's arms as a result of the spring bias of its coiled portion presses the coiled portion tightly against the part.

The socket openings are arranged in rows and columns which provide adjustable locations for connecting each clip's ends to the rack bar. This also provides adjustment in the amount of force which the clip's coiled portion exerts against individual parts.

The object of the invention is to provide a racking system that can be used for sequentially anodizing and painting long or large parts without requiring unracking. The anodizing bar is attached to the rack bar of each unit in the system prior to anodizing. It provides the needed current-carrying capacity to place a sufficient electrical charge on the parts. After anodizing is finished, the anodizing bar is removed from the rack bar, and from the overhead support, so that it will not shield the parts during painting.

The rack bar's structural configuration minimizes the effect it has on shadowing. Since the bar's part-supporting fingers project outwardly from the thin-side of the bar, the parts are consequently racked perpendicularly to the rack bar's wide-side surfaces, which minimizes paint shadowing. Of course, use of the invention still requires a certain amount of touch-up work after painting. This is minimal, however, and the labor associated with touch-up is more than offset by the labor savings which result from eliminating the requirement to unrack the parts.

The invention will become better understood upon consideration of the following description which is to be read in conjunction with the drawings.

BRIEF DESCRIPTION OF THE DRAWINGS

Like reference numerals are used to designate like parts throughout the several views in the drawings, and.

BEST MODE FOR CARRYING OUT THE INVENTION

Figure 1:
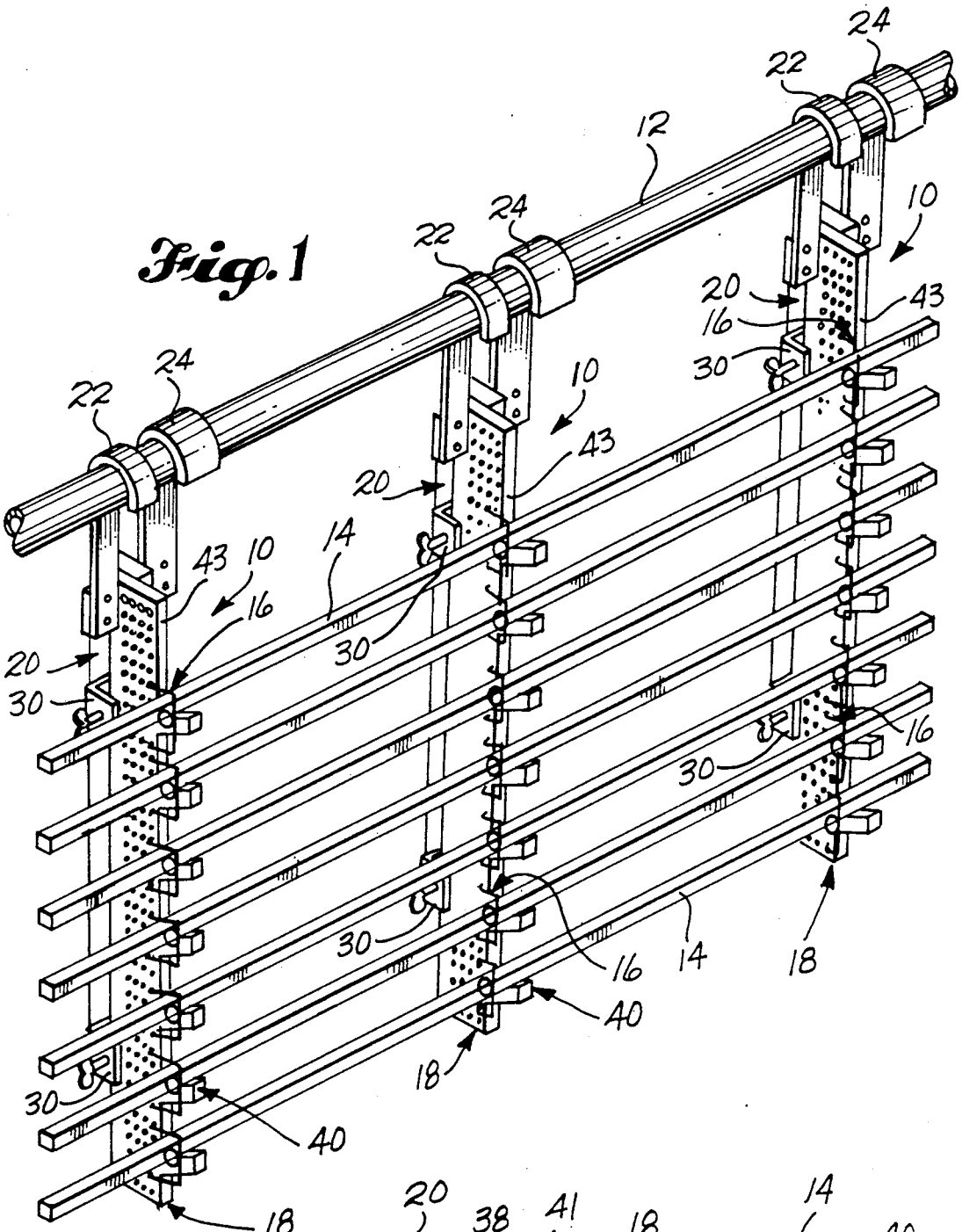
FIG. 1 is a pictorial view of three common rack units making up a racking system in accordance with a preferred embodiment of the invention, and shows the units hanging from an overhead support and holding a plurality of elongated parts.

Referring now to the drawings, and first to FIG. 1, shown generally at 10 are three common rack units constructed in accordance with a preferred embodiment of the invention. Each unit 10 hangs vertically from a generally horizontal overhead support 12. The units 10 cooperatively provide a racking system for supporting a plurality of elongated parts 14, each individually secured to the units 10 by straddle clips 16. This will be further described later.

The various figures show a large degree of part duplication throughout the various views. For example, each rack unit 10 is shown supporting a large number of equally-identical aircraft parts 14 and staddle clips 16. Such parts 14 may be, for example, aircraft, stringers that are approximately 3 inches wide and up to 30 feet in length. For the sake of convenience, and in order to make it easier to review the drawings, reference numerals may sometimes be drawn only to one part in situations where it is duplicated many times over in a set. For example, in FIG. 1, reference numeral 16 is drawn to only one of the seven straddle clips shown for each unit 10.

Figure 2:
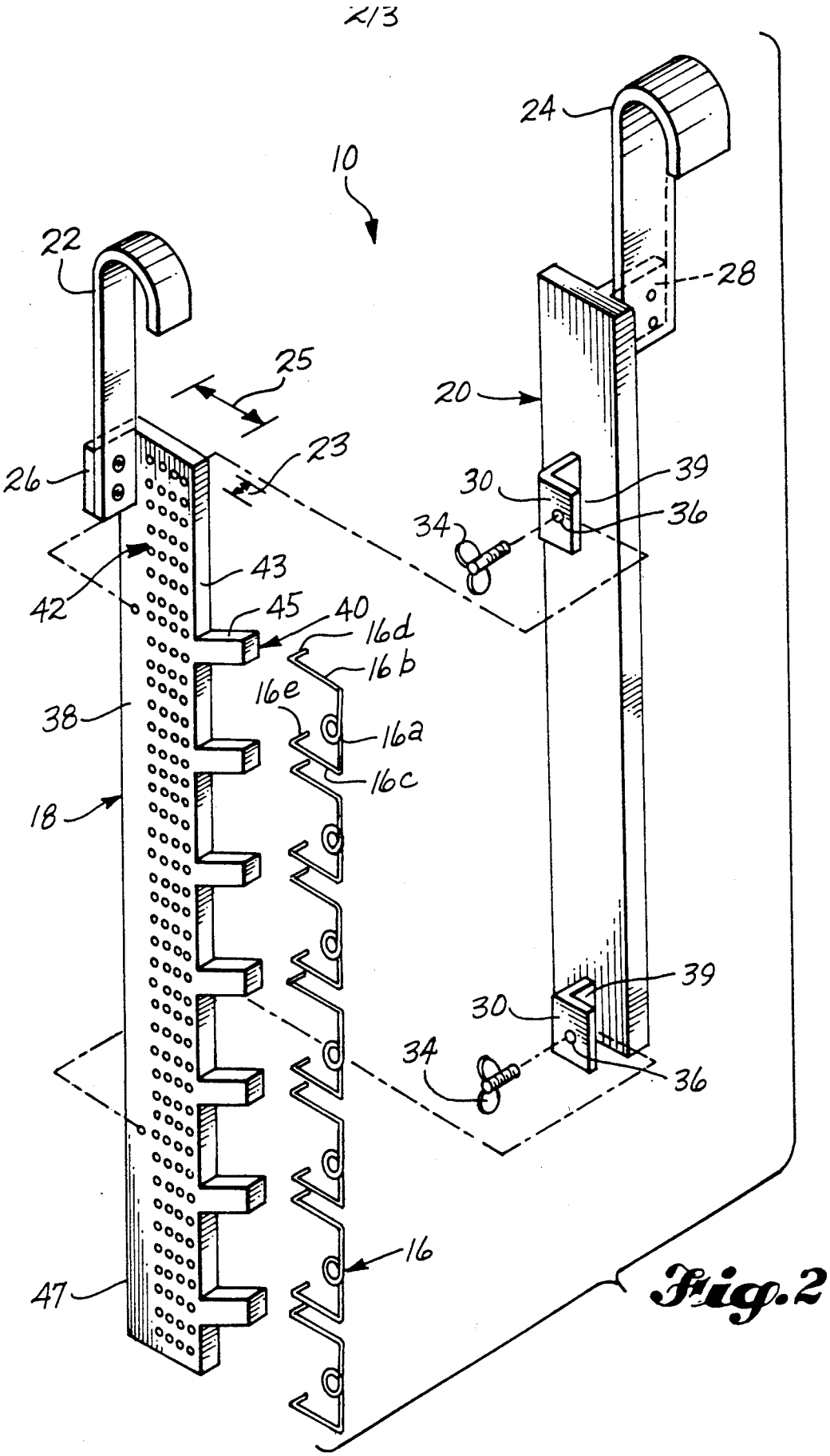
FIG. 2 is an exploded pictorial view of one of the common rack units shown in FIG. 1.

Referring to FIG. 2, each rack unit 10 includes a first electrically-conductive rack bar 18, and a second electrically-conductive anodizing bar 20. As is shown, both bars 18, 20 are elongated and generally rectangular in shape. As is also apparent from FIGS. 3 and 4, the rack bar 18 may be somewhat longer than the anodizing bar 20.

Figure 6:
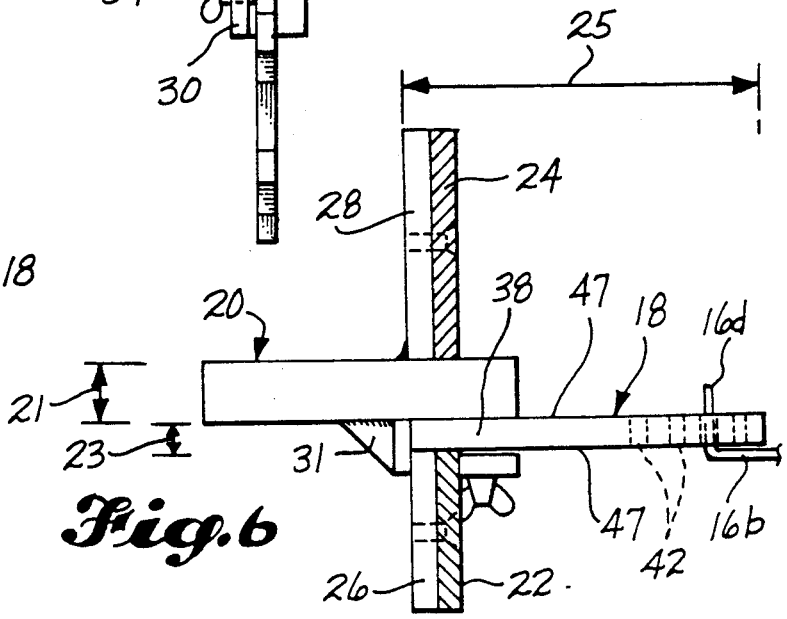
FIG. 6 is a cross-sectional view of the unit shown in FIG. 3 and is taken substantially along line B—B of FIG. 3, but does not show the rack fingers or parts held by the fingers.

The anodizing bar 20 is much thicker than the rack bar 18, as is illustrated, respectively, at 21 and 23 in FIG. 6. This is preferable in order to enable the anodizing bar 20 to carry the current loads required for anodizing. The rack bar is much thinner than it is wide, to minimize shielding of paint spray (numeral 25 in FIG. 6 illustrates its width; numeral 23 illustrates its thickness).

The rack bar 18 is provided with a hook-shaped hanger 22 that connects it to overhead support 12, in a manner so that the bar hangs vertically downwardly from the support. The anodizing bar 20 is provided with a similar hook-shaped hanger 24. Both hangers 22, 24 are shown bolted to tabs 26, 28 that project from, respectively, rack and anodizing bars 18, 20. The tabs 26, 28 are preferably welded directly to their respective bars 18, 20. Of course, attaching the hangers 22, 24 to the bars 18, 20 could be accomplished in other suitable ways, so long as there is good electrical continuity between the hangers and their respective bars.

As a person skilled in the art would realize, the overhead support 12 provides the source of electrical current which would be required to anodize the parts 14. Therefore, it is important that the hangers 22, 24 be made of an electrically-conductive material, and shaped so that they are in good electrical contact with overhead support 12.

Figure 5:
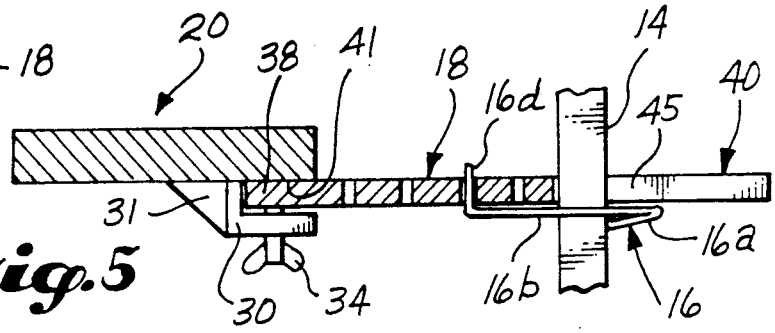
FIG. 5 is a cross-sectional view of the unit shown in FIG. 3 and is taken substantially along line A—A of FIG. 3.

As is best seen in FIGS. 5 and 6, the anodizing bar 20 is releasably joined or attached to the rack bar 18. This is accomplished by insertion of the rack bar's rear lateral edge portion 38 into slots or spaces 39 defined by clamping brackets 30 (see FIG. 2). The clamping brackets are welded to the anodizing bar 20, and have buttresses 31 which provide structural support.

The rack bar's rear edge portion 38 is held tightly in the clamping brackets 30 by wing bolts 34. These are threaded through openings 36 in each bracket 30. Tightening the wing bolts 34 causes the rack bar 18 to be tightly pressed and held against the anodizing bar 20, and defines an area of electrical contact between the bars that extends substantially along the entire length of the anodizing bar 20. This contact area is shown at 41 in FIGS. 3 and 5.

Each rack bar 18 is provided with a plurality of part-supporting fingers 40 which project outwardly from the bar's thin side 43, opposite the bar's rear lateral edge portion 38. Fingers 40 also project slightly upwardly so as to form an acute angle between the upper surface 45 of each finger 40, and the rack bar's thin side edge 43. This enhances the part-supporting ability of the fingers 40, and encourages the parts 14 to rest or abut directly against side 43, thus making good electrical contact.

The rack bar 18 also has a plurality of socket openings 42 distributed substantially along the entire length of the rack bar's wide side 47. Preferably, these socket openings 42 extend through the entire thickness of the rack bar as is illustrated in FIGS. 5 and 6. As is further shown in FIGS. 2 and 3, the socket openings 42 are organized into rows and columns. The rows extend along substantially the entire length of the rack bar 18 from top to bottom. The columns are distributed along only a portion of the bar's wide side 47, from substantially its finger-side to the area 41 of contact between the rack and anodizing bars 18, 20.

The socket openings 42 enable attachment of the straddle clips 16 to the rack bar. Each straddle clip 16 consists of a single piece of spring wire formed into a generally squared-off "U" shape. The central portion of the "U" consists of a coiled portion 16*a*. Arms 16*b*, 16*c* extend outwardly from opposite sides of the coiled portion. Each end has a tip 16*d*, 16*e* which is bent perpendicularly relative to its respective arm 16*b*, 16*c*. The tips 16*d*, 16*e* are sized for insertion into any one of the rack bar's socket openings 42. This connects each straddle clip 16 to the rack bar 18.

Figure 3:
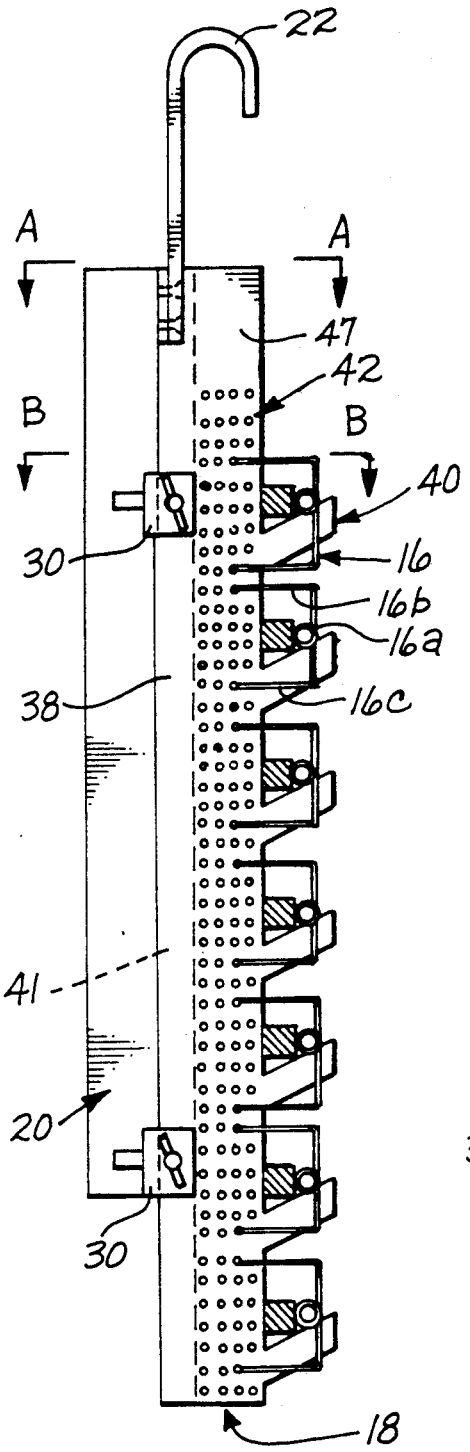
FIG. 3 is a side elevational view of one of the common rack units shown in FIG. 1, with the overhead support omitted.
Figure 4:
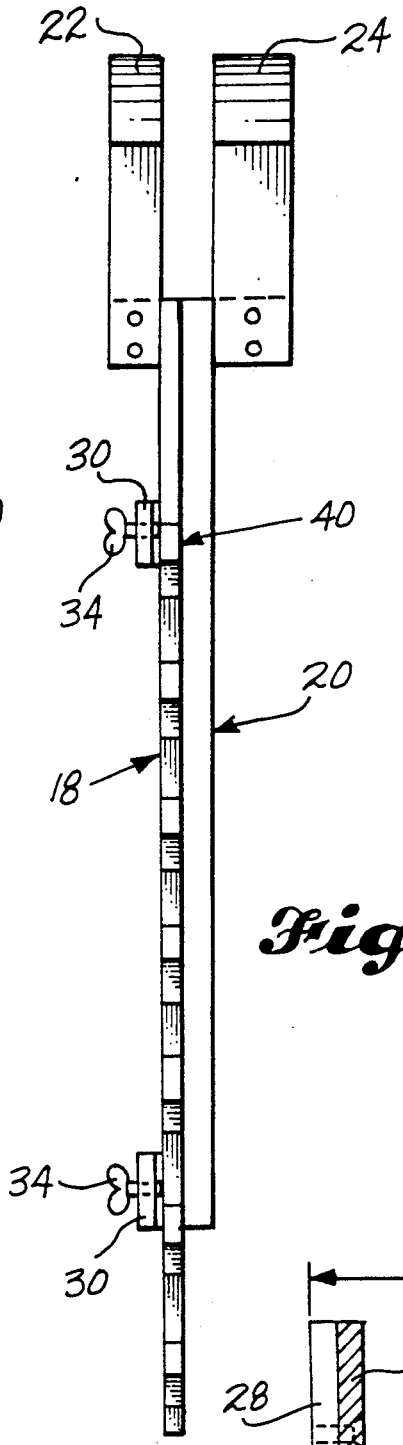
FIG. 4 is a front elevational view of one of the common rack units shown in FIG. 1, but with the overhead support, parts, and straddle clips omitted.

FIG. 3 best illustrates how the clips 16 are connected to the rack bar 18, and how they function to hold parts 14 onto individual rack bar fingers 40. The arms 16*b*, 16*c* of each clip 16 straddle its respective part 14. The clip's coiled portion 16*a* may abut directly against the part 14. The clip's tips 16*d*, 16*e* are pulled inwardly against the bias of the coiled portion 16*a* so that the resultant tension in arms 16*b*, 16*c* holds the tips in their respective socket openings. This further holds the coiled portion 16*a* tightly against the part 14.

The plurality of socket openings 42 in rack bar 18 provides adjustability of the tension in the straddle clips 16 which can be varied depending on the size of the clip or cross-section of the parts 14. The clips 16 ensure that the parts 14 will not move and that there will be good electrical contact between the parts 14 and the rack bar 18.

The typical processing sequence involving the use of each rack unit 10 is as follows: First, a plurality of rack bars 18 are hung from overhead support 12 in sufficient numbers to adequately hold the parts 14 which are to be anodized and painted. Then, the parts 14 are racked by placing them onto the part-supporting fingers 40 across the racks, and attaching or securing them with the straddle clips 16. This is followed by hanging an anodizing bar 20 next to each rack bar, and clamping the two bars together. Since the clamping brackets 30 of each anodizing bar permit the rack bar to slide relative to the anodizing bar prior to tightening the wing bolts 34, the anodizing bar's hanger 24 automatically aligns with the rack bar's hanger 22, in the manner shown in FIGS. 1 and 4. At this stage, the parts are ready to be anodized.

After anodizing, the anodizing bars 20 are unclamped and removed from the rack. The parts 14 and rack bars 20 are then painted. Small areas of the parts 14 may require minor touch up with paint, because of minimum shadowing caused by the rack bars 20. This may be done, however, while the parts 14 are still mounted to the rack bars. After painting, the parts are removed from the rack bars and sent on for further processing. The rack bars and straddle clips may be stripped of paint in a molten salt bath, and then reused.

The preceding description sets forth what is believed to be the current best mode for carrying out the invention. Certainly, certain changes could be made to the racking system as described above without departing from the spirit and scope of what is considered to be the invention. It is to be understood that the invention is defined and limited only by the following patent claims, wherein such claims are to be interpreted in accordance with the well-established doctrines of patent claim interpretation.

What is claimed is:

1. A common rack system for anodizing and painting operations, comprising:

a first electrically conductive elongated bar for supporting a plurality of parts to be anodized and painted;

a second electrically conductive elongated bar having a substantially larger cross section than said first bar, and being releasably joinable to said first bar in a manner so as to define an area of contact between said bars;

wherein said second bar is joined to said first bar when said parts are to be anodized, and said second bar is detached from said first bar prior to painting said parts so as to minimize paint shadowing.

2. The invention set forth in claim 1, including a hook-shaped hanger member attached to said first bar, to permit said first bar to be vertically hung from an overhead support.

3. The invention set forth in claim 1, including a hook-shaped hanger member attached to said second bar, to permit said second bar to be vertically hung from an overhead support.

4. The invention set forth in claim 1, including a first hook-shaped hanger member attached to said first bar, to permit said first bar to be hung from a generally horizongal overhead support, and a second hook-shaped hanger member attached to said second bar, to permit said second bar to also be hung from said overhead support, said first and second hanger members being sized and arranged so that when said second bar is joined to said first bar and said bars are simultaneously hung from said support, said bars will hang substantially vertically from said support and said hook-shaped hanger members will both be in electrical contact with said support.

5. The invention set forth in claim 1, wherein said first and second bars are each substantially rectangular in shape.

6. The invention set forth in claim 1, wherein at least one joining bracket is attached to said second bar, said joining bracket being shaped to receive an edge portion of said first bar, and a wing bolt in threaded engagement with and extending through a portion of said joining bracket, for holding said edge portion of said first bar in said joining bracket.

7. The invention set forth in claim 6, wherein two of said joining brackets are attached to said second bar.

8. The invention set forth in claim 1, further comprising:

said first bar having a thickness that is substantially less than its width, and having a plurality of part-supporting fingers projecting outwardly from an elongated thin side of said first bar, wherein each of said fingers also projects slightly upwardly in a manner so as to form an acute angle between each finger and said thin side of said bar.

9. A rack bar for use in a common racking system during anodizing and painting operations, said rack bar comprising:

an elongated bar having a thickness that is substantially less than its width, said bar having a plurality of part-supporting fingers projecting outwardly from an elongated thin side of said bar, and a plurality of socket openings in an elongated wide side of said bar, said socket openings being distributed substantially along the length of said wide side of said bar.

10. The invention set forth in claim 9, wherein each of said part-supporting fingers also projects slightly upwardly in a manner so as to form an acute angle between each finger and said elongated thin side of said bar.

11. The invention set forth in claim 9, wherein said plurality of socket openings is arranged in a plurality of rows and columns, said columns being regularly spaced along at least some of the width of said elongated wide side of said bar, and said rows being regularly spaced along substantially the length of said elongated wide side of said bar.

12. The invention set forth in claim 9, including a plurality of retainer clips for securing said parts onto said part-supporting fingers, each clip comprising:

a piece of spring wire formed to have a coiled central portion, and a pair of arms extending away from opposite sides of said coiled portion, and each arm having a tip that is bent perpendicularly relative to each arm, each tip being sized for insertion into a socket opening in said wide side of said bar, to secure said clip to said bar.

13. The invention set forth in claim 12, wherein said central portion and said pair of arms are shaped to generally form a "U", and said tips are substantially parallel to each other and extending in the same direction.

* * * * *